US009354011B2

(12) United States Patent
Cooke et al.

(10) Patent No.: US 9,354,011 B2
(45) Date of Patent: May 31, 2016

(54) MAGAZINE BASED, FIREARM SAFETY APPARATUS FOR MODIFYING EXISTING FIREARMS EMPLOYING A DIGITAL, CLOSE PROXIMITY COMMUNICATIONS SYSTEM AND A LOW POWER ELECTRO-PERMANENT MAGNET INTERLOCK SYSTEM

(71) Applicant: ANFCS, LLC, Rio Rancho, NM (US)

(72) Inventors: Benjamin T. Cooke, Spicewood, TX (US); George Andy Erickson, Los Alamos, NM (US); Robert Borgeson, Bulverde, TX (US); Jacob Borgeson, Austin, TX (US); Daniel Seitz, Los Alamos, NM (US); Douglas William Bench, Rio Rancho, NM (US)

(73) Assignee: ANFCS, LLC, Rio Rancho, NM (US)

( * ) Notice: Subject to any disclaimer, the term of this patent is extended or adjusted under 35 U.S.C. 154(b) by 0 days.

(21) Appl. No.: 14/745,590

(22) Filed: Jun. 22, 2015

(65) Prior Publication Data

US 2015/0377574 A1 Dec. 31, 2015

Related U.S. Application Data

(60) Provisional application No. 62/016,714, filed on Jun. 25, 2014.

(51) Int. Cl.

| | |
|---|---|
| ***F41A 17/06*** | (2006.01) |
| ***F41A 17/56*** | (2006.01) |
| *F41A 9/61* | (2006.01) |

(52) U.S. Cl.

CPC ..... *F41A 17/063* (2013.01); *F41A 17/56* (2013.01); *F41A 9/61* (2013.01)

(58) Field of Classification Search

USPC ..... 42/70.11

See application file for complete search history.

(56) References Cited

U.S. PATENT DOCUMENTS

| | | | | |
|---|---|---|---|---|
| 3,939,679 | A | 2/1976 | Barker et al. | |
| 4,003,152 | A | 1/1977 | Barker et al. | |
| 4,110,928 | A | 9/1978 | Smith | |
| 4,135,320 | A | 1/1979 | Smith | |
| 4,488,370 | A | 12/1984 | Lemelson | |
| 4,682,435 | A * | 7/1987 | Heltzel | F41A 17/063 42/70.01 |
| 4,793,085 | A * | 12/1988 | Surawski | F41A 9/53 42/1.05 |
| 6,321,478 | B1 | 11/2001 | Klebes | |
| 6,363,647 | B2 | 4/2002 | Kaminski | |
| 6,412,207 | B1 * | 7/2002 | Crye | F41A 17/02 42/70.01 |

(Continued)

*Primary Examiner* — Troy Chambers
*Assistant Examiner* — Joshua Semick
(74) *Attorney, Agent, or Firm* — Dennis F. Armijo

(57) ABSTRACT

A magazine-based firearm interlock that can be added to a commercial firearm, with a release/locking device on the firing mechanisms enabled by an electro-permanent magnet, control electronics in the removable magazine, and authorized through a wearable authorization device. Modifications are applied to the trigger bar or sear mechanism which enables it to be changed to an unlocked state, which allows a shot to be fired, and to a locked state, which prevents a shot from being fired. A communication system includes a chip set in the firearm magazine that communicates with a FOB carried by the user, which authenticates the user and activates the electro-permanent magnet to enable the firearm to fire. This system is preferably a near field communication system that couples to and transmits across the body of the user. Indicators can be included to indicate the operational state of the interlock and to detect and record discharges.

21 Claims, 12 Drawing Sheets

(56) References Cited

U.S. PATENT DOCUMENTS

| | | | | |
|---|---|---|---|---|
| 6,771,161 | B1 | 8/2004 | Doi et al. | |
| 7,222,450 | B2 * | 5/2007 | Cuprin | F41A 17/066 42/70.11 |
| 7,703,229 | B2 * | 4/2010 | Parhofer | F41A 17/063 42/70.01 |
| 7,770,316 | B2 * | 8/2010 | Meyerle | F41A 17/063 102/202.5 |
| 8,046,948 | B2 * | 11/2011 | Mauch | F41A 17/063 42/70.01 |
| 8,549,780 | B2 * | 10/2013 | Emde | F41A 17/063 42/70.01 |
| 8,935,872 | B2 * | 1/2015 | Zukowski | F41A 17/36 42/70.02 |
| 9,115,944 | B2 * | 8/2015 | Arif | F41A 17/063 |
| 2001/0032405 | A1 | 10/2001 | Kaminski | |
| 2001/0032407 | A1 | 10/2001 | Cain et al. | |
| 2002/0021206 | A1 | 2/2002 | Wootton et al. | |
| 2007/0079540 | A1 * | 4/2007 | Giebel | F41A 17/063 42/70.11 |
| 2009/0255160 | A1 * | 10/2009 | Summers | F41A 17/063 42/70.01 |
| 2011/0005115 | A1 * | 1/2011 | Cahill | F41A 9/66 42/49.01 |
| 2012/0180357 | A1 | 7/2012 | Dietel et al. | |
| 2014/0150316 | A1 * | 6/2014 | Acarreta | F41A 17/02 42/70.06 |
| 2014/0290109 | A1 * | 10/2014 | Stewart | F41A 17/063 42/70.01 |
| 2015/0153124 | A1 * | 6/2015 | Carlson | F41A 17/063 42/70.02 |
| 2015/0253093 | A1 * | 9/2015 | Allan | F41A 17/46 42/70.06 |

* cited by examiner

MAGAZINE BASED, FIREARM SAFETY APPARATUS FOR MODIFYING EXISTING FIREARMS EMPLOYING A DIGITAL, CLOSE PROXIMITY COMMUNICATIONS SYSTEM AND A LOW POWER ELECTRO-PERMANENT MAGNET INTERLOCK SYSTEM

RELATED APPLICATIONS

This application claims the benefit of U.S. Provisional Application No. 62/016,714, filed Jun. 25, 2015, entitled A MAGAZINE BASED, FIREARM SAFETY APPARATUS FOR MODIFYING EXISTING FIREARMS EMPLOYING A DIGITAL, CLOSE PROXIMITY COMMUNICATIONS SYSTEM AND A LOW POWER ELECTRO-PERMANENT MAGNET INTERLOCK SYSTEM, the specification of which is incorporated by reference.

BACKGROUND OF THE INVENTION

1. Field of the Invention (Technical Field)

The present invention relates in general to firearms, and in particular, to apparatuses and methods for preventing an unjustified, unauthorized use of firearms, and/or for allowing an authorized use thereof.

2. Background Art

There are several known approaches for preventing an unauthorized use of firearms. Most of these systems prevent the firearm from firing unless an authorized user is authenticated. Most, if not all of these systems change the position of firing components within the firearm to prevent firing for an unauthorized user and allow firing for an authorized user.

U.S. Pat. Nos. 3,939,679 and 4,003,152 to Barker, et al., disclose a safety system for enabling devices such as firearms, which enables an authorized person or persons to discharge a firearm upon authorization. This device has a solenoid that is energized to rotate a latch to enable or disable firing. This device also discloses a wristband with a battery transmitter for communicating with a receiver in the firearm.

U.S. Pat. No. 4,110,928 to Smith describes a safety device for preventing unauthorized actuation of a touch-actuated mechanism. This device describes a pin or bar that pivots and locks the trigger when not magnetically engaged. An authorized user wears a magnetic ring on his trigger finger, which engages the pivot pen allowing the firearm to discharge.

U.S. Pat. No. 4,135,320 to Smith is similar to U.S. Pat. No. 4,110,928 to Smith; however, this device contains a blocking mechanism to prevent the hammer from releasing unless a magnetic ring, worn by the user, disengages the hammerlock.

U.S. Pat. No. 4,488,370 to Lemelson describes a system with a trigger lock mechanism that is enabled and disabled via a solenoid in the weapon. The trigger lock mechanism is enabled and disabled through a transmitted code from a ring or wristband over a short distance to a receiving antennae within the weapon.

U.S. Pat. No. 6,321,478 to Klebes describes a firearm having an intelligent controller. This Smith & Wesson® device is limited to bullets with chemically conducted non-impact primers. In addition, there are several authorization systems disclosed, including fingerprints, electronic passwords, and the like.

U.S. Pat. No. 6,363,647 to Kaminski discloses a firearm with a safety system having a communication package. This device describes another method and system for authorization of use of a weapon using certain coding and communication systems for enabling and disabling the blockers. This system describes a blocker that moves in and out of the path of the trigger bar, preventing the trigger bar from moving rearward.

U.S. patent application Ser. No. 2001/0032407 to Cain, et al., describes a firearm safety system. This system discloses a passive unique RF tag embedded in a ring or wristband of the user that communicates with an RF system disposed on the firearm that engages and disengages a latch. The latch mechanism interferes with the hammer of a revolver or either the hammer or action of the slide in a semi-automatic weapon.

U.S. Patent Application No, 2002/0021206 to Wootton, et al., describes an apparatus and method for user control of appliances. This system describes a method using authorized user units incorporated in badges or other devices that generate a uniquely coded waveform to the weapon. By using this method, more than one authorized user can fire the weapon. The weapon has a solenoid when deactivated and blocks the mechanical motion of the gun's hammer or trigger.

U.S. Patent Application No. 2012/0180357 to Dietel, et al., describes a safety apparatus for a firearm. This is yet another weapon authorization system that prevents unauthorized users from firing the weapon by preventing movement of the firing pin.

SUMMARY OF THE INVENTION

Disclosure of the Invention

The presently claimed invention provides an apparatus, system, and method that can be attached to modify an existing firearm to provide an interlock system for prevention of unauthorized use. This novel system solves the shortcomings of the prior art and improves on the technology and safety of "Smart Weapons". Depending on whether or not there is an authorization to use a weapon, the trigger bar or drop safety bar inside the firearm are changed into positions with electro-permanent magnets (EPMs) that allow a shot to be fired or prevent it from being fired, i.e., the firearm is unlocked or locked. Furthermore, a firearm usable by authorization is unlocked when a person holding the firearm is carrying an authorized device anywhere on his/her body. The person cannot fire the weapon without this authorization equipment. The system uses an electro-permanent magnet that is installed within the firing mechanism, or within close proximity to the trigger bar at the top of the magazine, to move a trigger bar in and out of alignment with a sear mechanism by the triggering of the electromagnets. In an alternative embodiment, a split trigger bar may be used to prevent the trigger movement from engaging the sear mechanism. The authentication and communication with the electromagnets is provided with a near field communication system that couples to and transmits across the body of the user via a chip set housed inside the firearm's magazine. The chip set in the magazine communicates to a FOB-like device on the user. The term FOB is defined as a small security hardware device with built-in authentication used to control and secure access to network services and data. The FOB may be a FOB similar to a FOB used in a car, or may be part of a wrist device, or coupled to a metal clip on a belt. A token is communicated between the magazine and the FOB on the authorized user that provides a unique identifier through the chip set for authorization.

It is the object of the claimed invention to provide measures and means that increase the safety when firearms are used based on authorization. This system is specifically designed to be a simple retrofit to existing commercially available firearms.

Other objects, advantages, and novel features, and further scope of applicability of the presently claimed invention will be set forth in part in the detailed description to follow, taken in conjunction with the accompanying drawings, and in part will become apparent to those skilled in the art upon examination of the following, or may be learned by practice of the claimed invention. The objects and advantages of the claimed invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes for Carrying Out the Invention

FIGS. 1-12 show the preferred embodiments of the apparatus, system, and method for a magazine based interlock for prevention of unauthorized use of a firearm. Please refer to FIGS. 1-12 for the description below.

The presently claimed invention provides a safety apparatus, which is provided for a firearm. The safety apparatus comprises a release/locking device using electro-permanent magnets, an electronic system housed in the magazine that communicates with and controls these locking magnets, and a wearable element that the firearm user attaches to their body for the purpose of transferring the authorization wirelessly to the control and communication element in the removable magazine.

Figure 1:
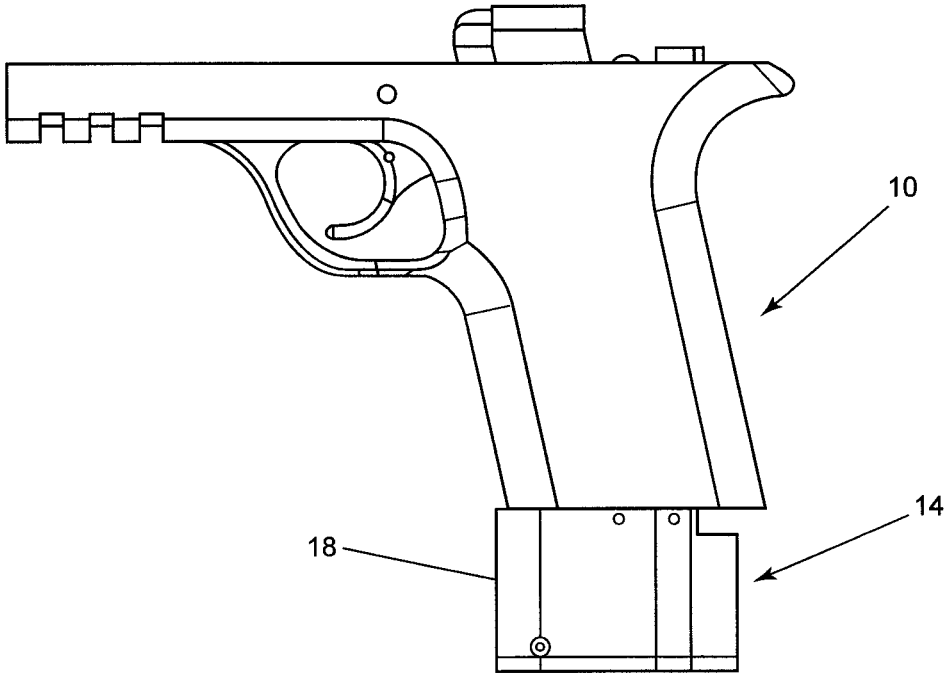
FIG. 1 is side view of the preferred magazine inserted into a firearm body.
Figure 2:
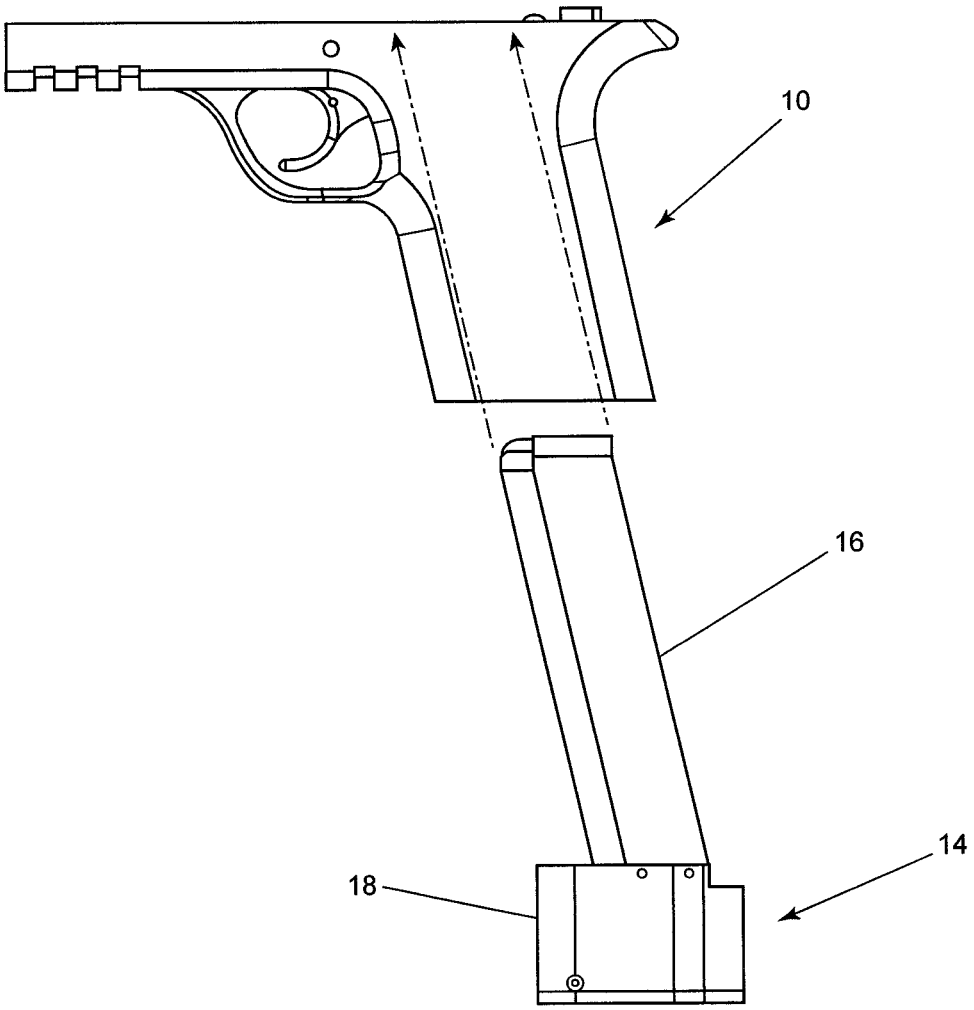
FIG. 2 is a side view of the embodiment of FIG. 1 with the magazine removed.
Figure 3:
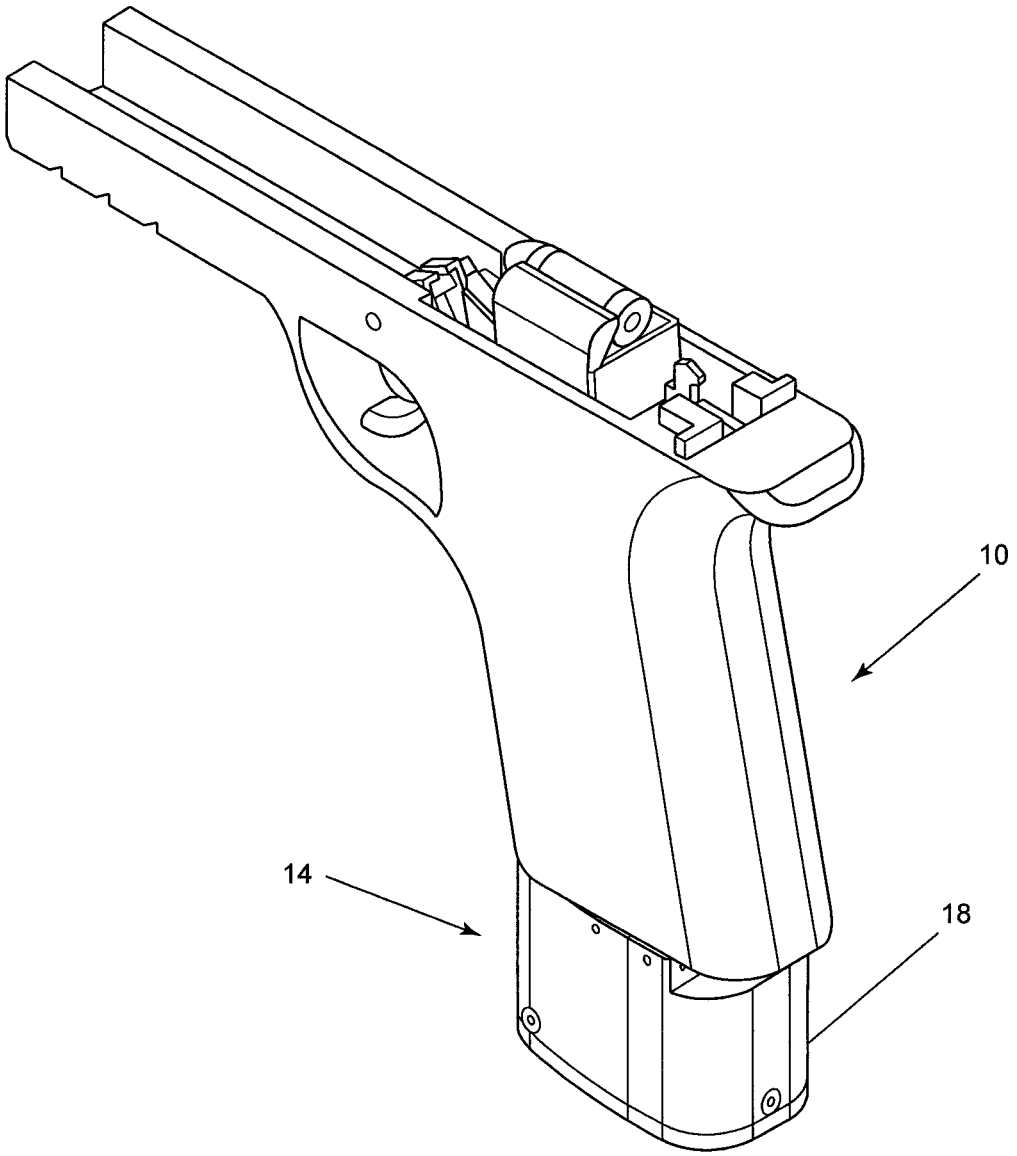
FIG. 3 is a perspective view of FIG. 1.

FIGS. 1, 2 and 3 depict a typical firearm body 10 with an inserted magazine 16; however, magazine 16 in these embodiments has been modified to include the interlock as defined herein. The magazine-based firearm system 14 comprises all of the required components for the interlock to be housed in magazine 16. FIG. 2 is a side view of the embodiment of FIG. 1 with magazine 16 removed from firearm receiver 10, and FIG. 3 shows the embodiment of FIG. 1 in a perspective view. The state changing components as described below are housed in magazine extension 18 to enable it to function for many different types of ammunition and firearms. Modifications to the firearm firing assembly are also described below.

Figure 4:
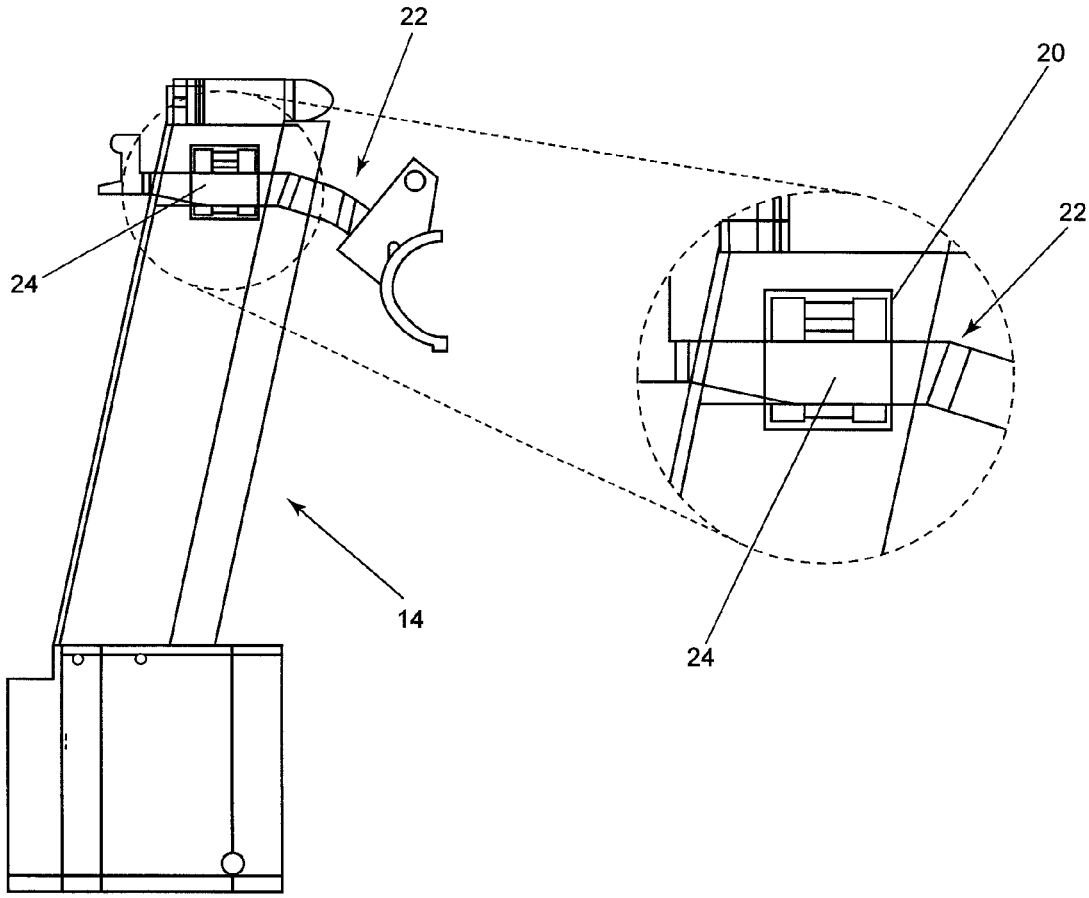
FIG. 4 shows the magazine with modifications for the preferred magazine based interlock system.
Figure 7:
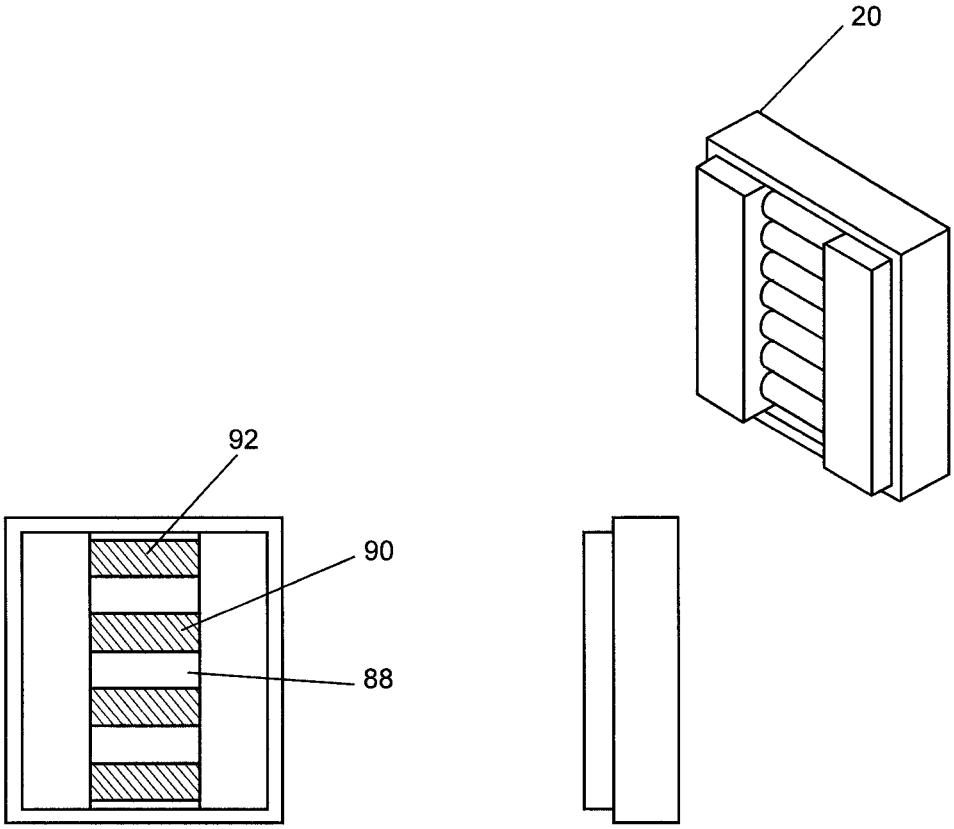
FIG. 7 shows the preferred EPM.

FIG. 4 shows the magazine-based firearm interlock system 14. Switchable magnets 20, preferably EPMs are applied to a firing mechanism 22 after the firearm has been manufactured and sold, enabling magazine-based firearm interlock system 14 to be applied to any model of firearm. A preferred embodiment of EPM 20 is shown in FIG. 7, and preferably is comprised of multiple magnetic cores of two different types placed in close proximity to one another. One core type is typically a strong permanent magnet 88, and second core 90 is made from a material that can easily change magnetic polarity. EPM 20 is switched on or off by providing an electrical current into one or two coils 92 contained in EPM 20. Coils 92 are wound together, but in opposite directions from each other around a core material that is easily magnetized. When a current is momentarily passed through one coil, a magnetic field is induced that permanently sets the magnetic polarity of the core to one direction (North/South). If the current is then passed through the other complementary coil, the magnetic polarity of the core is set to the opposite direction (South/North). A single coil 92 can alternatively be used, but the flow of current is simply reversed in order to switch the permanent magnetic polarity of the material. When the magnetic polarities of the two magnets are in the same direction, the resulting fields combine, forming a single strong magnet from the device. When the polarities are in the opposite directions, the fields shunt, providing a device with little to no magnetic field. Electrical signals are only provided to change state and, thus, the electro-permanent magnet is extremely low power. The special design of EPM 20 is designed to be thin enough as to be built into the wall of existing handgun magazines without interfering with normal operation. Although this disclosure describes an EPM, any other type of magnet or EPM can be used and is specifically made part of this disclosure.

Figure 5:
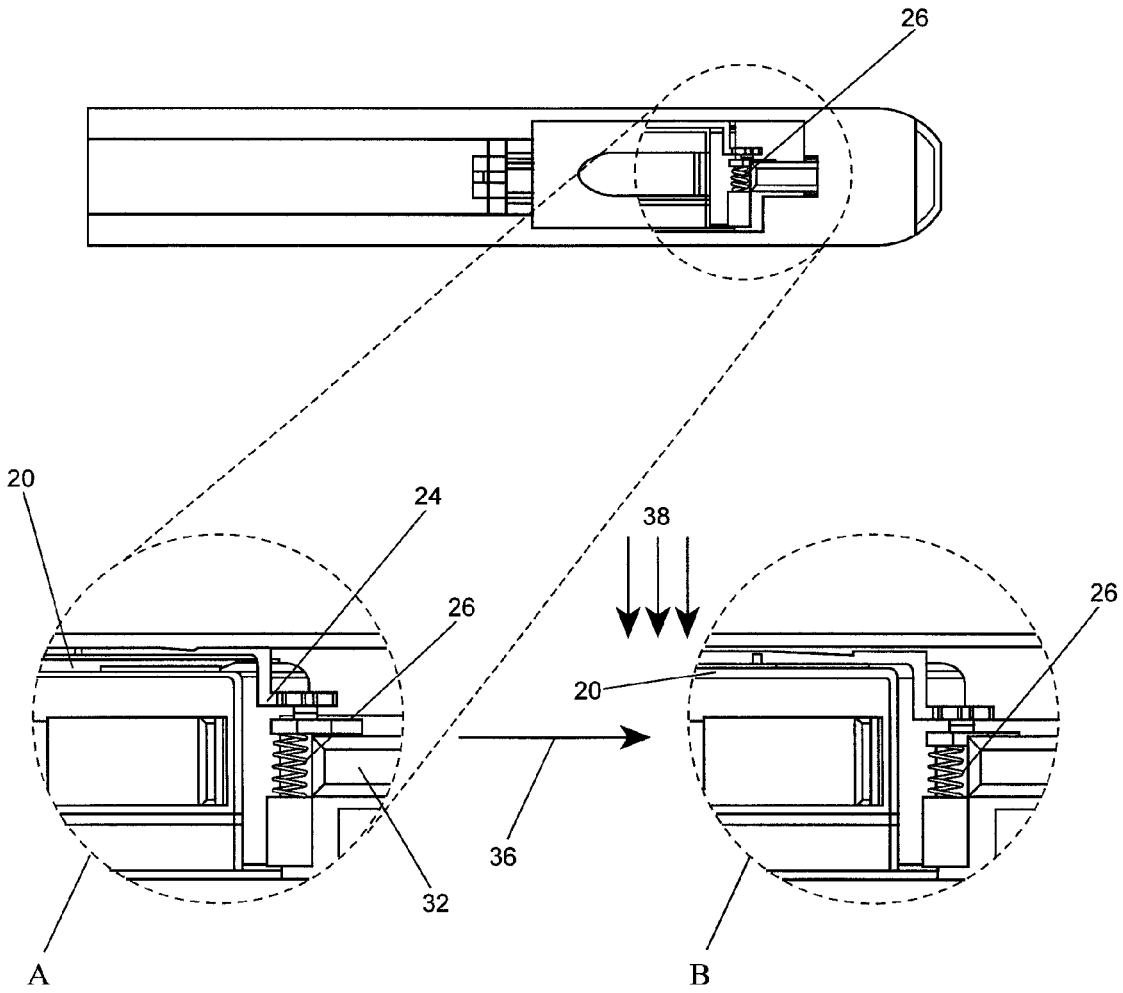
FIG. 5 shows details of the Electro-Permanent Magnets (EPM) and trigger bar assembly with a spring.
Figure 6A:
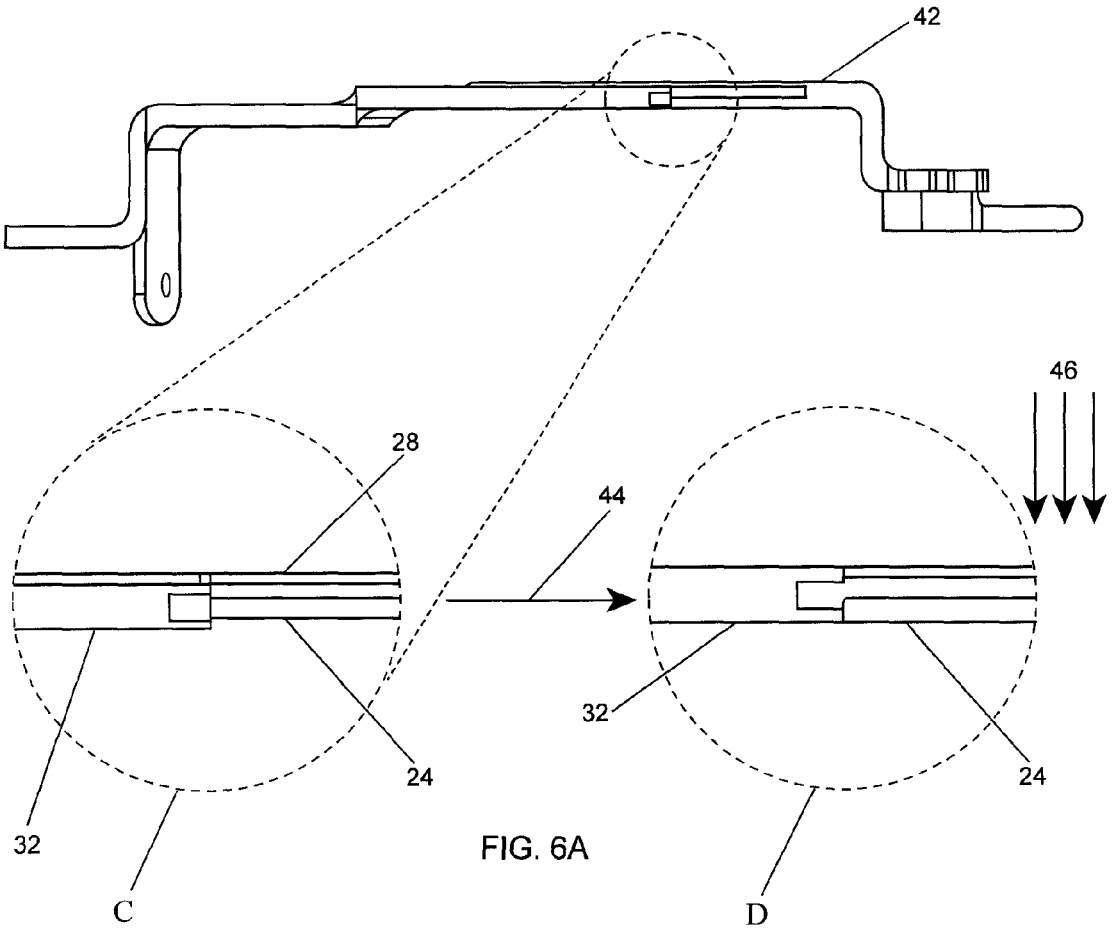
FIG. 6A shows the EPM and trigger bar assembly with an integral spring.

In the embodiments described herein, trigger mechanism 24 is normally out of alignment with the use of spring 26 or integral spring or flexure spring 28, of FIGS. 5 and 6A, when magazine 12 is not inserted or magazine 12 is inserted but disabled. A more detailed description is below. Springs 26 and 28 that maintain the out of alignment state can be embodied as an individual spring 26 that acts against trigger mechanism 24 or integral or flexure spring 28 incorporated into trigger bar 24 with the use of a broken/sprung trigger bar design. Magnetic pull 30 of EPM 20 is required to pull the trigger mechanism into alignment to allow the weapon to fire. EPM 20 is strategically placed to move trigger bar 24 into a firing position when EPM 20 is activated. The release/locking device can be created out of existing parts in a firing mechanism by activating EPM 20 near trigger bar 24. In the off state, springs 26 or 28 force trigger bar 24 out of alignment with the sear mechanism 32. This is the fail-safe state if no power is available or the magazine is removed. Once electrically activated, EPM 20 becomes much stronger magnetically and pulls trigger bar 24 into alignment, enabling the firing by actuating (pulling) the trigger of firearm 10. EPM 20 only requires an electrical signal to change state (from on to off or off to on). This reduces battery 46 requirements and increases the operational use of the weapon. In order to modify a firearm to employ this system, spring 26 or 28 is added to trigger bar 24 near sear 32 to maintain a misaligned state.

Alternatively, in the case of split trigger bar 42, trigger bar 24 would be replaced with a split trigger bar 42 that would incorporate flexion spring 28 to maintain the misalignment. Magazine 16 that incorporates this system includes EPM 20 installed at the top of the magazine, wiring 86 in a channel internal to magazine 16 to connect EPM 20, wire to the body of the metal magazine 84 to create the coupling element for communications and an extender body 18 to house the electronics and batteries.

Figure 6B:
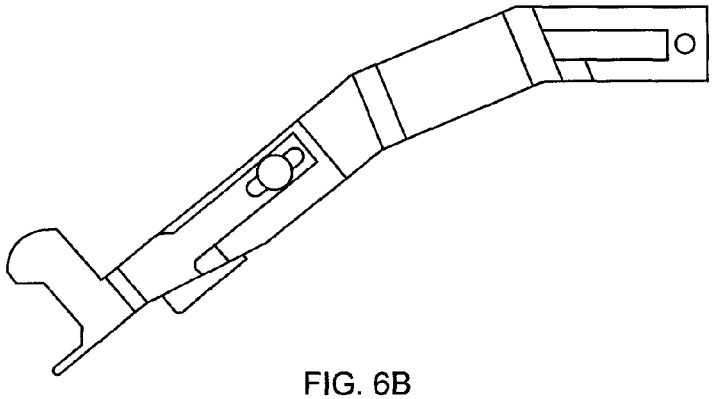
FIG. 6B shows a side view of the embodiment of FIG. 6A.

The two embodiments of the trigger bar systems are shown in FIGS. 5, 6A, and 6B. As discussed above, the first embodiment of FIG. 5 is the external spring loaded embodiment. In this embodiment spring 26, affixed to spring mount 40, misaligns trigger bar 24 from sear mechanism 32 as shown in expanded view A. This is the default position and prevents the firearm from firing. When EPM 20 is activated, the firing system transitions 36 to expanded view B. Activated EPM 20 magnetically pulls 38 trigger bar 24 toward EPM 20 and overcomes the tension of spring 26, which in turn aligns trigger bar 24 with sear 32. In this alignment, the firearm is in position to fire once the trigger is pulled.

The second trigger bar system is shown in FIGS. 6A and 6B. This system operates similar to the external spring loaded embodiment; however, in this embodiment an integral or flexure spring 28 is incorporated into split trigger bar 42. Expanded view C shows the split trigger bar 42 in the default no-fire state. Integral or flexure spring 28 keeps split trigger bar 42 misaligned with sear 32. When EPM (not shown) is activated, trigger bar 24 is pulled magnetically 38 into alignment with sear 32, as shown in expanded view D and allows the firearm to be fired, once the trigger is pulled. FIG. 6B is a top view of the embodiment of FIG. 6A. In both of these embodiments, since the default position of the trigger bars is a no-fire state, the alignment is maintained even if the magazine is removed. Activation of EPM 20 is required for a fire condition.

Figure 8:
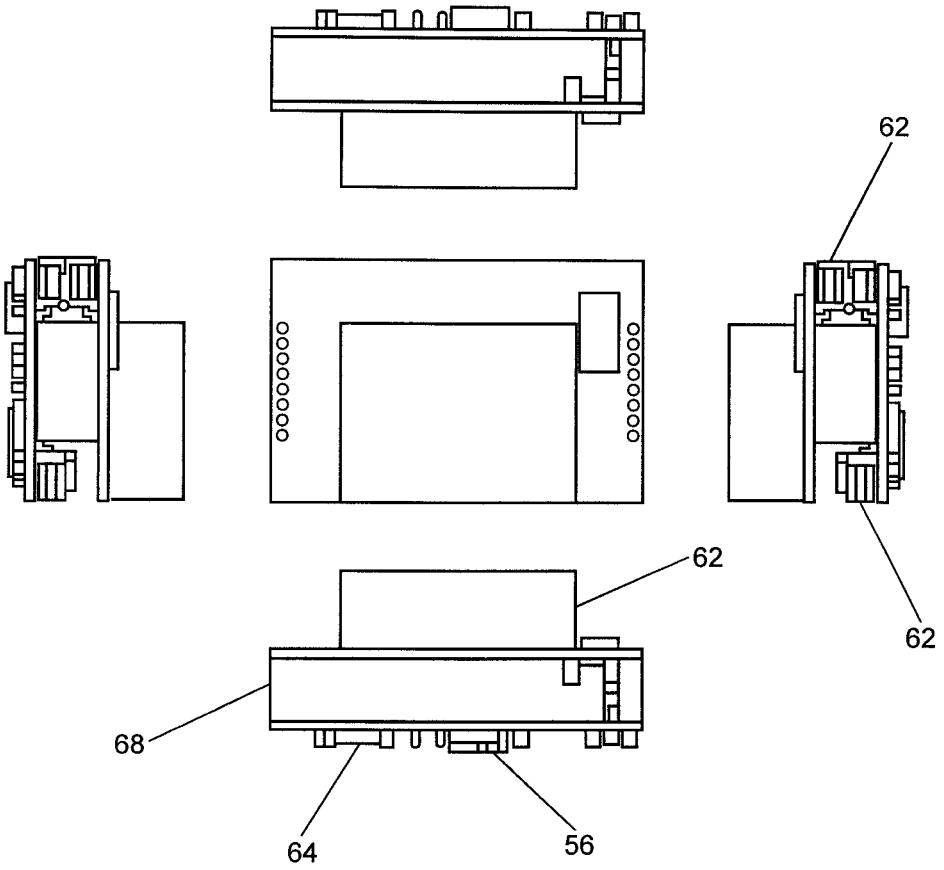
FIG. 8 is an exploded view of the magazine electronics

FIG. 8 shows multiple views of the interlock system authentication and communication device in magazine extender 18. The components of FIG. 8 are described in the block diagram for the magazine (FIG. 9)

FIG. 7 shows EPM 20 that is comprised of soft magnetic core 90, and hard, permanent magnetic core 88 that are wrapped with a wire forming a coil. The coil is driven by a momentary current that induces a magnetic field that sets the polarity of soft magnetic core 90. When the magnetic field of soft magnetic core 90 is aligned with hard, permanent magnetic core 88, the assembly produces a strong net magnetic field 38, 46 that overcomes the force of spring 26, 28, and pulls trigger bar 24, 42 in alignment with sear 32. When the magnetic polarity of the soft magnetic core is set by the coil opposite of the magnetic field of the hard magnetic core the net magnetic field is weak and does not produce sufficient force to overcome spring 26, 28, which maintains trigger bar 24, 42 out of alignment with sear 32.

Figure 9:
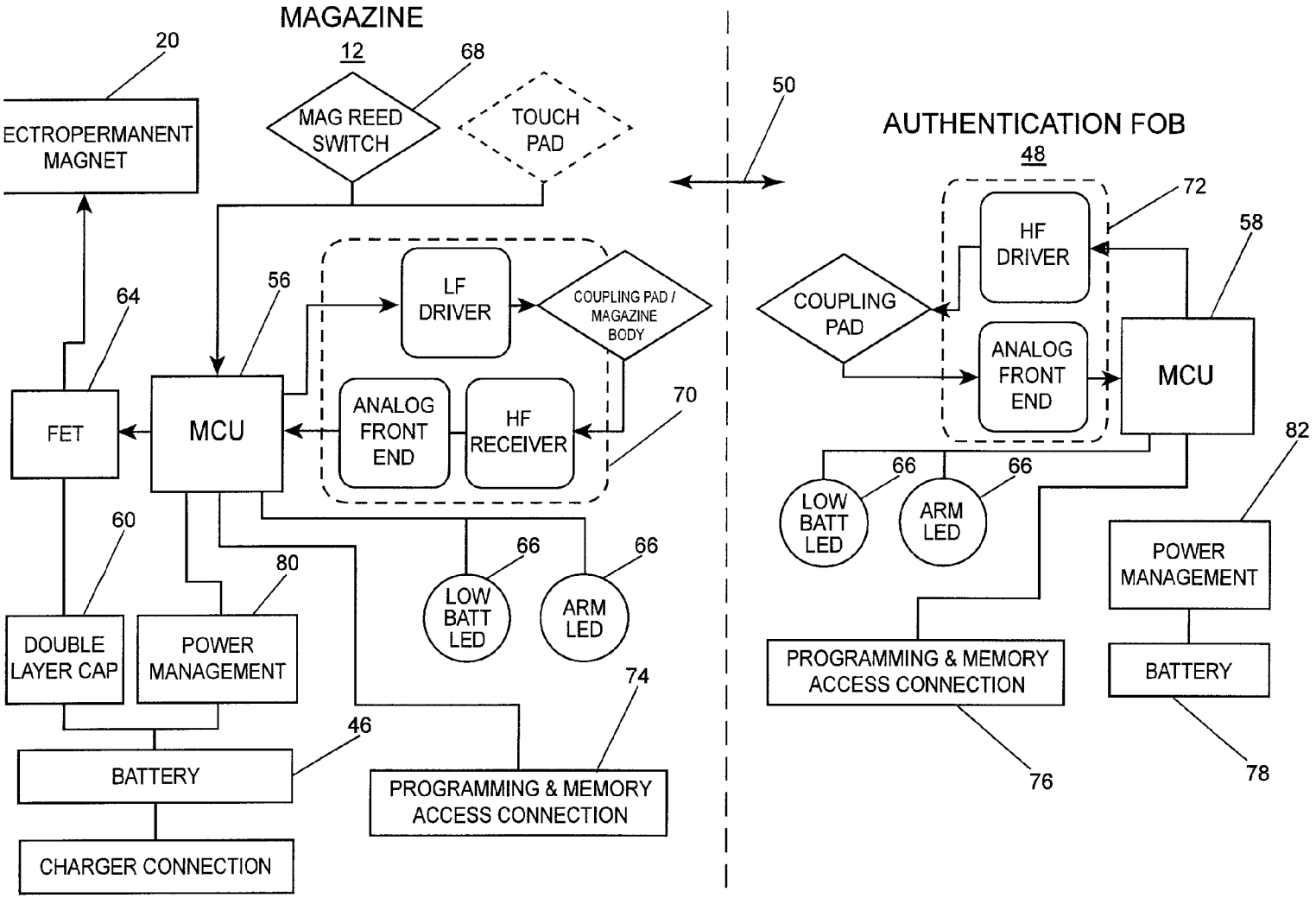
FIG. 9 is a block diagram the magazine based interlock system.
Figure 10:
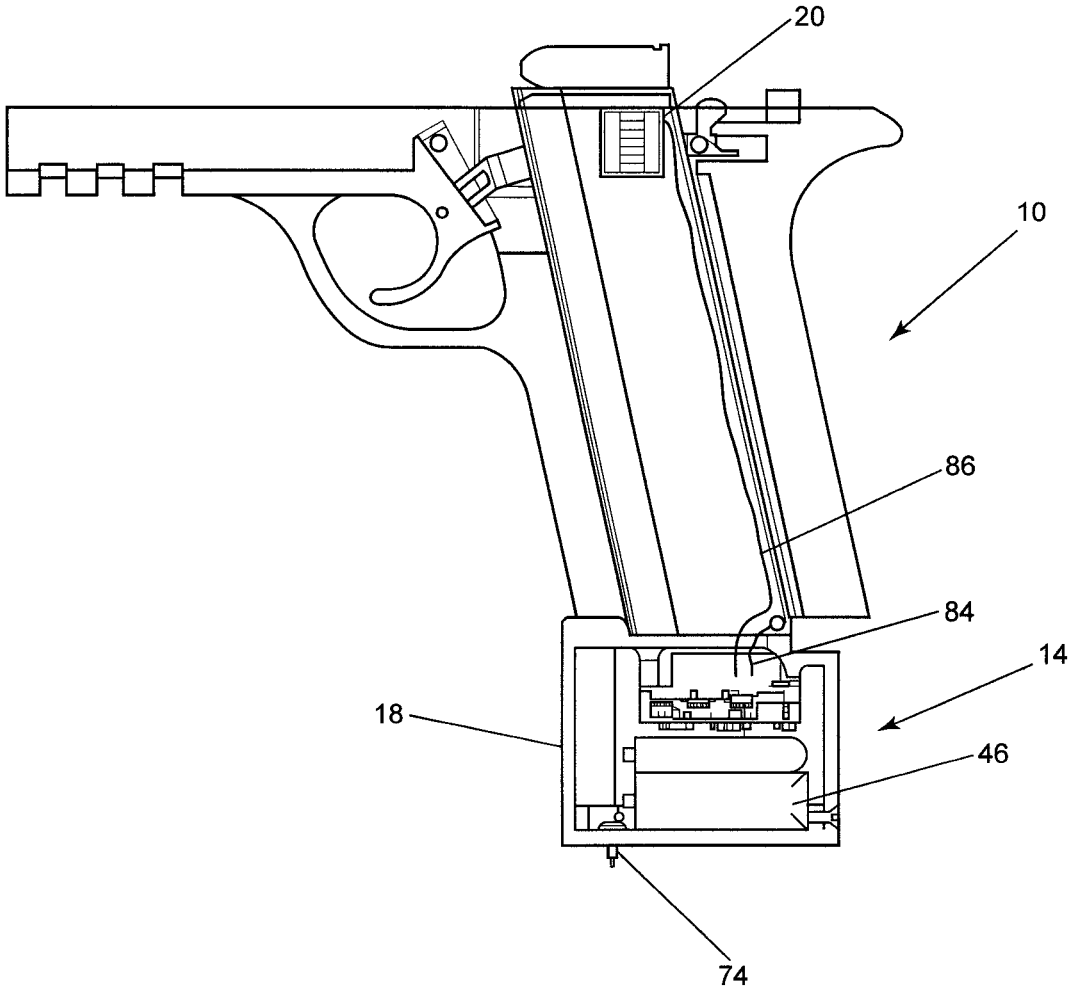
FIG. 10 is a cross section of the magazine based interlock system.

FIG. 9 is a block diagram showing the components of the magazine based interlock system. Magazine 16 communicates 50 with FOB 48 via coupling pad/magazine body 52 and coupling pad on authentication device or FOB 54. Communications front end 70 in magazine 16 generates a low frequency forward link sent to FOB 48 and down converts the high frequency return link signals received from FOB 48 communications front end 72. Communications front end 72 converts digital signals to modulated analog signals designed to traverse the human body with minimal attenuation. Capacitive coupled communications 50 are designed to take advantage of the metal body of the magazine body so that a separate coupling pad is not required for magazine 16. Magazine MCU 56 continually requests responses from FOB MCU 58 through communications system 50. When a FOB response is received and validated, magazine MCU 56 enables EPM 20 by momentarily switching Field-Effect Transistor (FET) 64 to discharge large capacitor 60 to produce a large current in EPM coils 92. In some embodiments, large capacitor 60 is not needed, as batteries 46 can supply sufficient current to switch EPM 20.

Magazine MCU 56 and FOB MCU 58 indicate the battery and firearm status by illuminating status indicators 66 on each device. In addition, power management circuit 80 in each device regulates the battery voltage to provide sufficient power to microcontroller units 56, 58. The programming and memory access connections 74, 76 are used to provide an external connection to a programming device that can update the microcontroller programs and authenticated ID database as well as the usage logs contained in the memory array internal to the MCUs 56, 58.

The communication medium used is the human body and the envelope of communication does not extend beyond a few inches from the skin. The radio in magazine 12 and authenticating device 48 are capacitively coupled to the user and, thus, communication between the devices is not intended to operate through the air, but through the human body. Use of capacitive coupling allows the user to use either hand to fire the weapon without the need for multiple authentication devices 54. Use of capacitive coupling allows the user to be wearing gloves and still enable the weapon to operate nominally.

The communicating signal can be attenuated in order to limit the distance on the user's body that the communication will operate. This would prevent the system from being enabled by one user holding the weapon while touching another user with a valid authentication device.

The communication between the magazine radio and the authentication device 54 is comprised of a digital packet of information. The integrity of the data packet is protected with a unique Cyclical Redundancy Check (CRC) or hash value of the data. This allows the receiving device to calculate the same value across the payload of the data packet and compare it to the value sent. If the calculated CRC or hash does not match the one received, the packet is ignored and considered lost.

Figure 11:
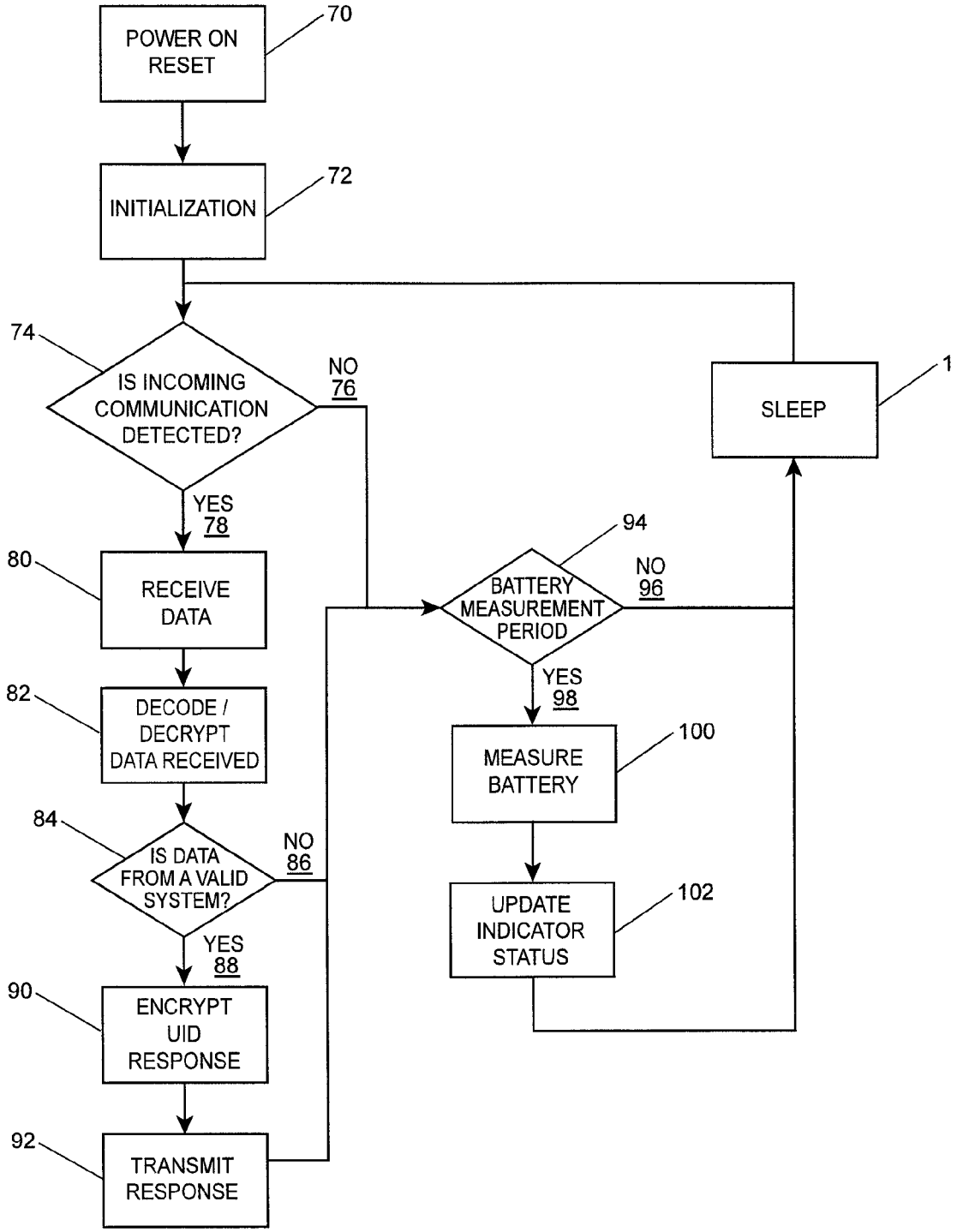
FIG. 11 is a flow chart showing the operation of the FOB magazine Microcontroller Unit (MCU) authentication.

FIG. 11 provides a flow chart of the basic operation of the firmware contained in the FOB MCU. At power on 70, the system is reset. The system is then initialized 72 and the system periodically checks whether an incoming communication is detected 74. If a communication is detected 78, the data is received 80. If the data is not received 76, the system reverts to an inactive state involving status checks and a sleep mode 104, described more fully below. Once the data is received 80, the system decodes and decrypts the received data 82 and validates whether the data was received from a valid or authorized system 86. If the system is validated 88, an encrypted Universal Identification (UID) response is created 90 and transmitted 92. If the data is not from a valid system 86, the system reverts to the inactive state involving status checks and the sleep mode 104. The status checks involve a battery measurement period 94, which provides for predetermined periods of time for measuring the capacity of the battery 100. If the period of time is designated for measurement 98, measurement is taken 100, the status indicators are updated 112, and the system enters into the sleep mode 104. If the time period is not designated for a battery measurement period 96, the system enters into a sleep mode 104.

Figure 12:
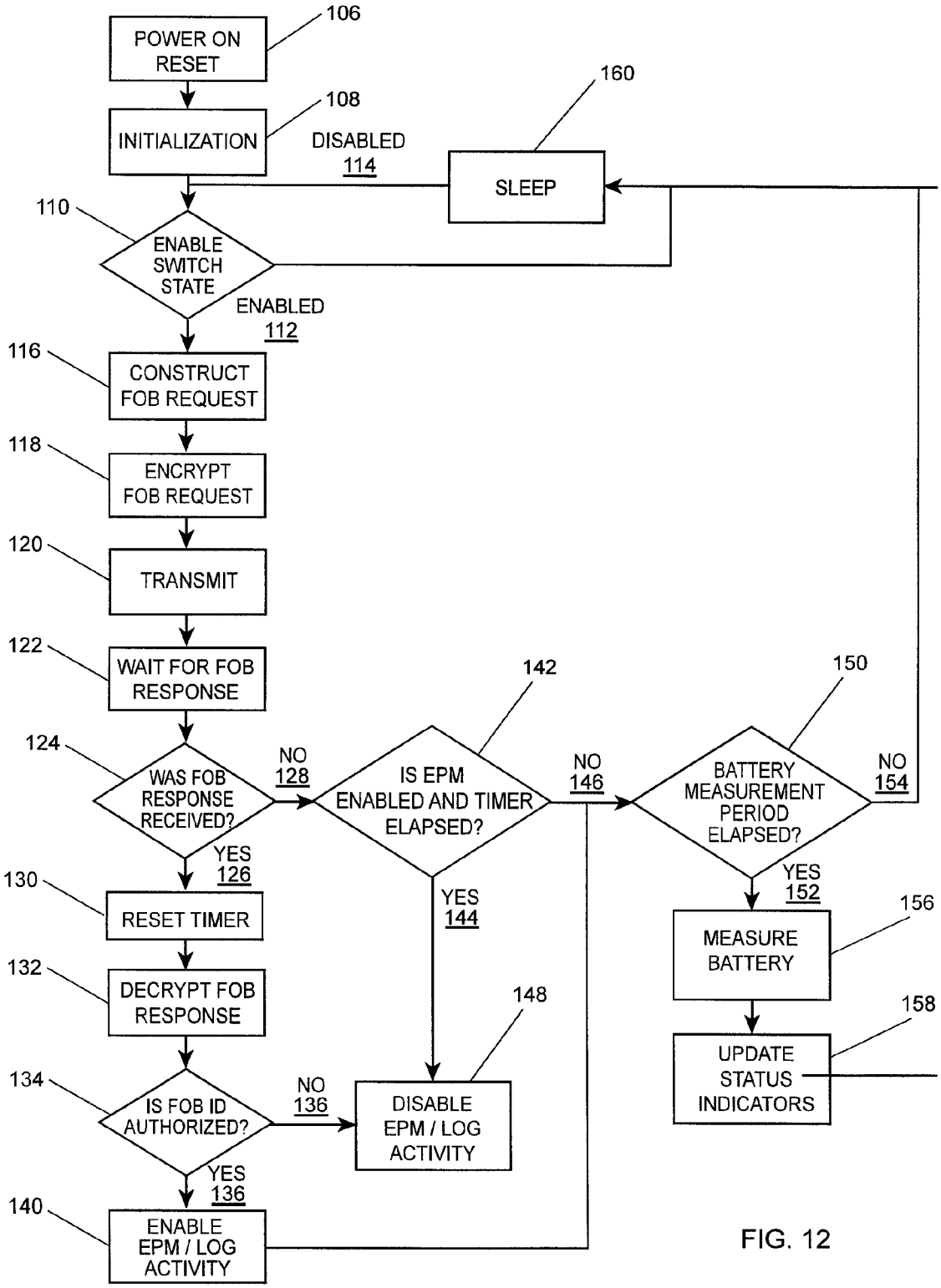
FIG. 12 is a flow chart showing the magazine interlock MCU operation.

FIG. 12 provides a flow chart of the basic operation of the firmware contained in the magazine MCU. At power on, the system is reset 106. The system is then initialized 108 and the enable switch state is determined 110. If the switch state is enabled 112, a FOB request is constructed 116. If the switch state is disabled 114, the system is placed in a sleep state 160 until there is a change in the enable switch state 110. Once the FOB request is constructed 116, the FOB request is encrypted 118 for transmission 120. The next step is to wait for a FOB response 122. If a FOB response is received 126, the timer is reset 130 and the FOB response is decrypted 132. A check is made whether the FOB is authorized 134, and if so 136, the EPM is enabled and the activity logged 140. If a FOB response is not received 128, a check is made whether the EPM is enabled and the timer elapsed 142. If the timer has elapsed 144 or the FOB is not authorized 138, the EPM is disabled and the activity logged 148. If the EPM is not enabled and the timer has not elapsed 146 and after the step of disabling the EPM 148 or the step of enabling the EPM 140, a check can be made whether the battery measurement period has elapsed 150. If the period has elapsed 152, the power level of the battery is measured 156 and the measurement shows up on a status indicator 158. If the measurement period has not elapsed 154 or after the stats indicator is updated 158, the system is placed in a sleep mode 160 awaiting a next initialization 108.

When authentication device 54 detects the presence of valid communications from the magazine radio, it continuously returns its identification number to the magazine radio. The system will remain enabled as long as a valid identification number is received within a period of time. This allows the system to be tolerant of noise or corruption in the communications that would arise as packet errors.

Since the packet transmitted from authentication device 54 always contains the same identification number, it can be encrypted using a rolling code method of encryption. A rolling code encryption method employs a large counter number that is combined with the identification number and is then encrypted using a shared key. After each packet is transmitted, the counter is incremented so that the encrypted packet being transmitted is always different. This counter value is learned and similarly incremented by the magazine system such that any valid counter value received must be larger than the last value received. This method of encryption prevents a third party from receiving a valid packet from the authentication device and simply retransmitting the packet to enable the system. This method of encryption is commonly found in garage door openers and wireless key remotes for automobiles.

Magazine Microcontroller Unit (MCU) 56 can store a number of valid authentication device identification numbers so that a number of authentication devices can be used with a single magazine. Either the authentication device identification numbers can be preprogrammed into magazine MCU 56 or they can be placed into a learning state. The learning state allows magazine MCU 56 to receive and record new authentication device identification numbers.

Beyond the identification number, a number of other pieces of information can be communicated between magazine 12 and authentication device 48. The battery status can be transmitted between the devices in order to indicate either device's battery state to each other for logging or displaying to the user. A sensor that detects when the weapon fires could be employed so that a count of the number of times a weapon was discharged could be stored on either magazine 12 or authentication device 48. Magazine 12 can also have an identification number that is transmitted to authentication device 48 to provide a log of which magazines have been used with a given authentication device or vise-versa. Authentication device 48 could also contain configuration data for magazine 12 so that various parameters of the interlock system could be changed depending on which authentication device 48 is used.

Since both devices in the system are battery powered, each device will operate in active and standby states to conserve power. In an active state, either device is continuously trying to establish communications with one another. Authentication device 48 remains in a low power standby state when no communications are present from magazine 12 and will be in a listen only mode that is duty cycled at a low rate. Magazine 12 can employ a number of methods to determine if it should operate in an active or standby state. A sensor can be employed that determines if the magazine is loaded into a firearm and/or if it is being held by a user. This sensor can be any type that can detect these states such as a simple switch, a capacitive touch sensor, hall sensor, or optical sensor. Another similar sensor can be employed to determine if the firearm is holstered or not. The magazine will only enter the active mode if it determines that any combinations of the following conditions are met: it is loaded into a firearm, the firearm is outside of the holster, and/or the firearm is being held by a user. Magazine 12 can include status indicators, such as Light Emitting Diodes (LEDs) that display system arm, locked, and number of bullets in clip 16, as well as other pertinent status information such as battery level and the like. Status indicators can be transmitted to a user's firing line of sight with the use of a fiber optic cable installed in the firearm.

The electronics and EPM 20 contained in magazine 12 are totally sealed in a material such as epoxy so that water, gun lubricants, powder by-products, and other environmental contaminants will not hinder operation. No wires or electrical contacts are needed between the magazine and the firearm.

A computer program that maintains a database of authorized magazines for a particular firearm or set of firearms in magazine MCU 56. This program allows groups, sub-groups, or individuals to be authorized or de-authorized easily through either wireless or wired connection.

An inductively coupled or wireless circuit charges the batteries in the magazine as well as communicates with the internal electronics so as to re-program the system or assess status.

FOB 48 can include a biometric identification detection method of its own for the purpose of insuring that the user is a specific, authorized individual. This biometric identification could utilize such technologies as fingerprint scanner, Electrocardiogram (ECG) signature detection, brain wave scanners, or other methods for the purpose of identifying a specific user through unique biological characteristics, comparing those characteristics to an approved user profile stored in the authentication device memory, and then providing the authorization signal to the firearm electronics through the established communication interface only if the profile matches the characteristics scanned. This scanning and matching operation can happen only once during the initial activation of the device, or it can happen continuously while the user is wearing the safety system.

According to embodiments, the release/locking device is adapted to be changed into a first state for a shot release and into a second state, which prevents a shot release. States, which do not allow a shot release, comprise a state where the trigger of the weapon is blocked up to a state in which the ammunition cannot be fired, for example, by preventing the firing pin from being actuated. Without intending a limitation to a conventional firearm locking, it can be said that such states result in an unlocked firearm, while states that prevent a shot, release lead to a locked firearm.

In such embodiments, the state changing device is adapted to change only the safety apparatus from a locked state to an unlocked state in the presence of a valid authorization signal from a wearable device. The receipt of this valid signal causes the state changing electronics to deactivate the electro-permanent magnets in order to restore the firing mechanism to normal operating positions.

Conversely, the state changing electronics also react to enable the magnets and lock the firearm when the authorization signal ceases to be received. The locks can only be enabled when the human body that is conjointly holding the wearable authorization device, and once again comes into close proximity with the weapon and the magazine containing the state changing electronics.

The authorization information provides an authorization to use the firearm and in particular for a shot release. The authorization information can be provided in the form of a digital signal encoded in a message passed through a Near Field wireless Communication (NFC) or a body coupled wireless communication that uses the human body as the medium of signal transmission. The authorization information can be transmitted to the safety apparatus through the device for checking the authorization of the firearm and/or an external apparatus or system. Only when such communication process is complete and proper authorization information is available can the electro-permanent magnets be deactivated and the firearm goes from the locked state to the unlocked state.

The state changing device responds instantly to the presence of an authorization signal, and maintains a state once authorization has been established through the communication interface until it stops receiving this signal. The state changing device also reads the signal to make sure it is an approved signal by comparing the digital identity encoded in the signal to a list of approved identities stored on the electronic memory in the magazine.

For communication to occur, the system utilizes body coupled wireless technology or Near Field wireless Communication (NFC), an industry standard approved short distance wireless protocol. The body coupled interface only functions in the presence of a human body as the appropriate medium of signal transmission. As such, it uses two signals, one contained in the state changing device in the magazine, and one contained in the wearable device that is permanently kept by the authorized firearm user. When one device moves a prescribed distance away from the body, the communication fails and the state changing device in the magazine, changes to a locked state immediately. NFC, or body wave communication, uses two inductively coupled antennas to communicate over distances up to five centimeters in the air, where one device is active and provides the initial signal and power and the wearable device reflects back encoded, programmable identification data. Thus, if the device moves out of this short range or otherwise is interrupted, the communication fails and the state changing device in the magazine changes to a locked state immediately. The body wave communication uses low power frequencies that use the body as a wave-guide, permitting the devices to communicate from the authenticator to the magazine passing the token to lock or unlock the firearm.

Furthermore, the wearable authorization device can be designed in any form that can be attached to a body, clothing, or appendages and still complete communication. The entire safety apparatus can change a firearm to an electronically controlled and authenticated weapon without the need to rebuild.

The actuation device can be adapted to change the state of the release/locking device in a first time period.

It is also possible that the state changing device is adapted to change the state of the release/locking device in a second time period. If available, it may be provided that the state maintaining device maintains the release/locking device in the respective state or in a second time period. The time periods in which the state changing device and/or the state maintaining device operate, can at least partially overlap or can be substantially identical.

The first and second time periods (and also further time periods mentioned below) can be time periods of a motion sequence of the user of the firearm in gripping, upholstering, or aiming the weapon to enable delays in the usage of a weapon if demanded.

The indication "in" a time period includes that the respective process (for example, changing the release/locking device from the first state into the second one) takes time, which is shorter than that of the associated time period or takes the substantially entire duration of the time period.

The second time period preferably follows directly the first time period. An intermediate time period can be present between the first and second time periods. In such an intermediate time period, electric, electronic, and/or mechanical processes may take place, which are correlated with the operation/use of the weapon. In such an intermediate segment, a cartridge could be conveyed into the cartridge chamber where it is positioned and/or a check-up can be performed as to whether or not there is an authorization to use the weapon. Furthermore, control operations, processes for target acquisition, etc., may take place.

It is provided that in such an intermediate segment, the release/locking device remains or is maintained in its respective state. This can be achieved by means of the actuation device, for example, when it does not change its state or does not change it in such a way that the respective state of the release/locking device is abandoned. This can also be achieved by way of alternative or supplementing the state maintaining device.

The actuation device and/or the state changing device can be adapted to be used to return the release/locking device to the respective initial state when its state was changed. This can be done in a third time period. The third time period can directly follow the second one or start at a distance of time from it.

Although the claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A magazine-based firearm interlock system for prevention of unauthorized use comprising:

a split trigger bar disposed on the firearm;

a spring which misaligns the split trigger bar on the firearm, wherein the spring is incorporated into the split trigger bar;

a magnet disposed on the magazine, when activated aligns the split trigger bar and allows the firearm to fire; and a communication system between a chip set disposed on the magazine and a FOB to authenticate the FOB and to activate the magnet.

2. The magazine-based firearm interlock system of claim 1 wherein the magnet comprises an electro-permanent magnet.

3. The magazine-based firearm interlock system of claim 1 wherein the communication system comprises a wireless body-coupled communication system between a first transceiver disposed on the magazine and a second transceiver disposed in the authentication FOB containing a unique identification (ID).

4. The magazine-based firearm interlock system of claim 1 further comprising interlock system status indicators.

5. The magazine-based firearm interlock system of claim 1 further comprising at sensor to place the interlock in a low power mode when the firearm is holstered or the interlock is not installed in a firearm.

6. The magazine-based firearm interlock system of claim 1 further comprising a sensor on the magazine for detecting firearm discharge events.

7. The magazine-based firearm interlock system of claim 1 further comprising at least one rechargeable battery.

8. The magazine-based firearm interlock system of claim 7 comprising rechargeable batteries and a recharging station.

9. The magazine-based firearm interlock system of claim 1 further comprising a programming station for reprogramming a chipset memory.

10. A method for authenticating an authorized user of a firearm via a magazine interlock to enable the firearm to discharge, the method comprising the steps of;

misaligning a firearm split trigger bar with a spring, wherein the spring is incorporated into the firearm split trigger bar;

providing a FOB configured to be disposed on the authorized user;

transmitting a unique ID from the FOB through a wireless body-coupled communication system to a chip set in the magazine interlock disposed on the firearm;

authenticating the unique ID by the chip set disposed in the magazine interlock against a list of unique IDs; and aligning the firearm sag trigger bar for firing by activating a magnet in the magazine interlock to pull the firearm split trigger bar.

11. The method of claim 10 further comprising the step of recording an activation state of the firearm to a memory in the chip set and the FOB.

12. The method of claim 10 further comprising the step of detecting discharges of the firearm with a sensor disposed on the magazine interlock.

13. The method of claim 12 comprising the step of recording the discharges to a memory in the chip set and the FOB.

14. The method of claim 10 comprising the step of sending out periodic requests to detect a presence of at least one FOB by the wireless body-coupled communication system.

15. The method of claim 14 comprising the step of misaligning the firearm split trigger bar if the at least one FOB is no longer detected for a predetermined period of time.

16. The method of claim 10 further comprising the step of encrypting communications between the chip set and the FOB with a rolling code encryption.

17. The method of claim 10 further comprising the step of logging FOB detections.

18. The method of claim 10 further comprising the step of indicating a status of the magazine interlock.

19. The method of claim 10 further comprising the step of switching the magazine interlock into a power saving mode when the firearm is holstered or the magazine interlock is not installed in a firearm.

20. The method of claim 10 further comprising the step of programming or pairing the magazine interlock with other authentication FOBS.

21. The method of claim 10 further comprising the step of downloading data from a memory in the chip set and the FOB.

* * * * *